US007835231B1

(12) United States Patent
Garcia

(10) Patent No.: US 7,835,231 B1
(45) Date of Patent: Nov. 16, 2010

(54) LINEAR TIME DISPLAY WITH SYMBOLIC INDICATORS

(76) Inventor: Christopher George Garcia, 1214 Cypress Dr., Richardson, TX (US) 75080

( * ) Notice: Subject to any disclaimer, the term of this patent is extended or adjusted under 35 U.S.C. 154(b) by 0 days.

(21) Appl. No.: 12/171,855

(22) Filed: Jul. 11, 2008

(51) Int. Cl.
*G04B 19/00* (2006.01)

(52) U.S. Cl. ..... 368/223; 368/82

(58) Field of Classification Search ..... 368/82, 368/223
See application file for complete search history.

(56) References Cited

U.S. PATENT DOCUMENTS

| | | | | |
|---|---|---|---|---|
| 964,005 | A | 7/1910 | Dungan et al. | |
| 991,935 | A | 5/1911 | Porter | |
| 1,776,001 | A | 11/1930 | Konigsberg | |
| 2,065,491 | A | 12/1936 | Harm | |
| 2,221,413 | A | 11/1940 | Schanz | |
| 2,243,343 | A | 5/1941 | Johnson | |
| 2,333,832 | A | 11/1943 | Torroja | |
| D163,856 | S | 7/1951 | Di Addario | |
| 3,574,992 | A | 4/1971 | Ladas | |
| 3,587,222 | A | 6/1971 | Mestrovic | |
| 3,775,964 | A | 12/1973 | Fukumoto | |
| 3,854,279 | A | 12/1974 | Edmunds | |
| 3,956,879 | A | 5/1976 | Bailey | |
| D241,627 | S | 9/1976 | Bailey | |
| D241,628 | S | 9/1976 | Bailey | |
| 4,022,015 | A | 5/1977 | Bailey | |
| 4,068,465 | A * | 1/1978 | Bacon | 368/188 |
| 4,103,484 | A | 8/1978 | Bailey | |
| D253,042 | S | 10/1979 | Fee | |
| 4,370,068 | A * | 1/1983 | Han | 368/240 |
| D275,938 | S | 10/1984 | Sonier | |
| D277,372 | S | 1/1985 | Sonier | |
| D297,816 | S | 9/1988 | Dawson, Jr. | |
| D302,664 | S | 8/1989 | Dawson, Jr. | |
| D337,531 | S | 7/1993 | Braisted | |
| 5,331,609 | A | 7/1994 | Gubin | |
| D353,777 | S | 12/1994 | Braisted | |
| D353,781 | S | 12/1994 | Braisted | |
| D354,006 | S | 1/1995 | Braisted | |
| 5,757,731 | A | 5/1998 | Rosenberg | |
| D405,701 | S | 2/1999 | Marshall | |
| 5,896,348 | A | 4/1999 | Lyon | |
| 6,249,486 | B1 | 6/2001 | Chitturi | |
| 6,256,265 | B1 | 7/2001 | Sepulveda | |
| 6,621,766 | B2 * | 9/2003 | Brewer et al. | 368/82 |
| 6,628,571 | B2 | 9/2003 | Emami | |
| D483,684 | S | 12/2003 | Kahil | |
| D496,296 | S | 9/2004 | Nataf | |
| D496,297 | S | 9/2004 | Kahil | |
| D496,298 | S | 9/2004 | Kahil | |

(Continued)

FOREIGN PATENT DOCUMENTS

| | | |
|---|---|---|
| DE | 19539220 | 4/1997 |

(Continued)

*Primary Examiner*—Vit W Miska
*Assistant Examiner*—Jason Collins
(74) *Attorney, Agent, or Firm*—Jeffrey Roddy

(57) ABSTRACT

A linear clock that contains a main body, twelve one hour indicators located on the main body, eleven five minute indicators interposed between the twelve one hour indicators, and four one minute indicators evenly spaced on the main body such that each indicator may be activated at an appropriate time to accurately represent the time.

21 Claims, 7 Drawing Sheets

U.S. PATENT DOCUMENTS

| | | | |
|---|---|---|---|
| D534,824 | S | 1/2007 | Skaggs |
| D535,207 | S | 1/2007 | Skaggs |
| D545,232 | S | 6/2007 | Waldman |
| D554,004 | S | 10/2007 | Kraft |
| 2002/0145945 | A1 | 10/2002 | Bucci |
| 2005/0083787 | A1 | 4/2005 | Perez |
| 2006/0256663 | A1* | 11/2006 | Sela ..... 368/62 |

FOREIGN PATENT DOCUMENTS

| | | |
|---|---|---|
| WO | WO9217826 | 10/1992 |
| WO | WO9917173 | 4/1999 |

* cited by examiner

LINEAR TIME DISPLAY WITH SYMBOLIC INDICATORS

BACKGROUND OF THE INVENTION

1. Technical Field

This invention relates to timepieces, and more particularly, to an electrical device for displaying time.

2. Description of Related Art

The history of clocks is very long, and there have been many different types of clocks over the centuries. The first way that people could tell the time was by looking at the sun as it crossed the sky. When the sun was directly overhead in the sky, it was the middle of the day, or noon. When the sun was close to the horizon, it was either early morning (sunrise) or early evening (sunset). The oldest type of clock is a sundial clock, also called a sun clock. They were first used around 3,500 B.C. The next great advance in timekeeping occurred in about 3450 B.C. when a primitive hourglass was invented. This device was basically a bowl with a hole in the bottom. Water dripped through the hole slowly as the day wore on and grooves cut into the side of the bowl measured the passage of time. The hour glass had many advantages over sundials, because they would work on cloudy days and at night.

The Greeks divided the year into twelve parts that are called months. They divided each month into thirty parts that are called days. Their year had a total of 360 days, or 12 times 30 (12×30=360). Since the Earth goes around the Sun in one year and follows an almost circular path, the Greeks decided to divide the circle into 360 degrees. The Egyptians and Babylonians decided to divide the day from sunrise to sunset into twelve parts that are called hours. They also divided the night, the time from sunset to sunrise, into twelve hours. Twelve is about the number of moon cycles in a year, so it is a special number in many cultures. The hour is divided into 60 minutes, and each minute is divided into 60 seconds. The idea of dividing the hour and minute into 60 parts comes from the Sumerian sexagesimal system, which is based on the number 60. This system was developed about 4,000 years ago. The first practical clock was driven by a pendulum. It was developed by Christian Huygens around 1656. By 1600, the pendulum clock also had a minute hand. One problem with pendulum clocks is that they stopped running after a while and had to be restarted. The first pendulum clock with external batteries was developed around 1840. By 1906, the batteries were inside the clock.

Quartz crystal clocks were invented in 1920. Quartz is a type of crystal that looks like glass. When you apply voltage or electricity and pressure, the quartz crystal vibrates or oscillates at a very constant frequency and the vibration moves the clock's hands very precisely. The next great advancement in timekeeping was in 1967 when the atomic clock, which used the oscillations of cesium-133 atoms, was developed to precisely to tell time. Almost all clocks use a round face to display the time. While these time displays have had a relatively long history, what is needed is a new and novel method of displaying the time.

SUMMARY OF INVENTION

The present invention solves the above-described problem by providing a device and method that uses a linear scale to determine the time. In general, in one portion of the timepiece are means of representing numbers 0/12-11 to represent hours and along a second portion interspersed between the one portion are means of representing 5-55 in 5 minute increments. In one embodiment, in a third portion, are additional means of representing 1-4 minute counters. In another embodiment, a fourth portion contains a means of representing 0-59 seconds.

In one embodiment, the device may be mounted on a wall, ceiling, or free standing. In another embodiment, the device may be worn as jewelry on the wrist, around the neck or hanging from a chain around the neck, or on an article of clothing. In yet another embodiment, the device is flexible and may be shaped into a curved or other aesthetically pleasing pattern. In yet another embodiment, the device may be mounted on, or incorporated into the side of a building or large structure. In yet another embodiment, the device may be incorporated onto a portable electronic device as a means for displaying time.

DETAILED DESCRIPTION OF THE INVENTION

Figure 1:
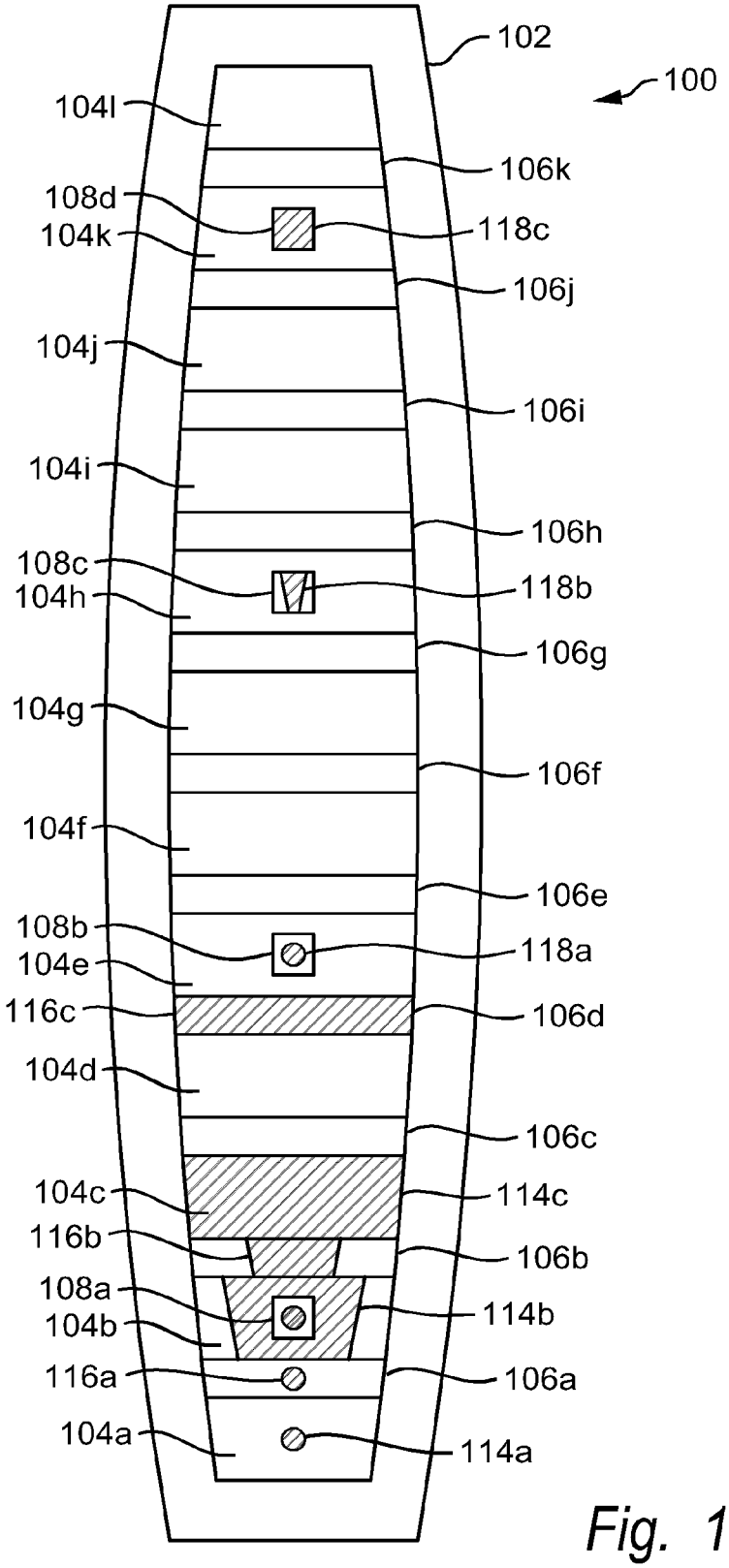
FIG. 1 is a plan view of a linear clock in accordance with an embodiment of the present invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Referring to FIG. 1, shown is one embodiment of linear clock 100. Linear clock 100 contains main body 102, hour sections 104, five minute sections 106, and one minute sections 108. Main body 102 contains the electronics necessary to allow linear clock 100 to function. In one embodiment, shown in FIG. 1, main body 102 is made of a rigid or relatively rigid material that allows main body 102 to remain upright.

In one embodiment, main body 102 is an LCD that is supported by a wall or is attached to a rigid or relatively rigid material. Main body 102 may have an aesthetically pleasing exterior. In one embodiment, shown in FIG. 1, the ends of main body 102 taper such that the widest part of main body

102 is proximate to the middle and the narrowest part of main body 102 is proximate to each end. However, it should be understood that main body 102 may have almost any profile that will contain hour sections 104, five minute sections 106, and one minute sections 108. In another embodiment, main body 102 is a single sheet of transparent or translucent material that is illuminated. By way of example and not of limitation, hour sections 104, five minute sections 106 and one minute sections 108 may be made of plate glass, acrylic or some other material that can carry light or illumination and/or allow for an edge-lit effect.

Hour sections 104 are contained in main body 102. There are twelve hour sections 104 and each section represents one hour of a twenty four hour clock. For example, as shown in FIG. 1, 104*a* represents the 0 or 12 o'clock hour, 104*b* represents the 1 o'clock hour, 104*c* represents the 2 o'clock hour, 104*d* represents the 3 o'clock hour, 104*e* represents the 4 o'clock hour, 104*f* represents the 5 o'clock hour, 104*g* represents the 6 o'clock hour, FIG. 104*h* represents the 7 o'clock hour, 104*i* represents the 8 o'clock hour, 104*j* represents the 9 o'clock hour, 104*k* represents the 10 o'clock hour, and FIG. 104*l* represents the 11 o'clock hour.

Each hour section 104 contains visually perceptible hour indicator 114 that is activated at the appropriate time. For example, at 1 o'clock, the visually perceptible hour indicator 114 contained in hour section 104*b* is activated. By way of example and not of limitation, visually perceptible hour indicator 114 may be a LED light 114*a*, light bulb, neon, or some other illumination source capable of producing a visual indicator. In one embodiment, hour sections 104 may be transparent or translucent such that upon activation of a visually perceptible hour indicator 114, at least a portion of the appropriate hour section 104 glows or is illuminated 114*b* or the entire appropriate hour section 104 glows or is illuminated 114*c*. The color or visual appearance of visually perceptible hour indicator 114 may be the same, or different for each hour section 104 or may change over the hour such that during the hour a specific hour section 104 is illuminated, the visual appearance changes. As the time passes, each hour section 104 that was previously illuminated may remain illuminated, blink, or may not be illuminated at all.

In main body 102, five minute sections 106 are interposed within or between each hour section 104. There are eleven five minute sections 106 and each section represents five minute increments of one hour. For example, as shown in FIG. 1, 106*a* represents 5 minutes, 106*b* represents 10 minutes, 106*c* represents 15 minutes, 106*d* represents 20 minutes, 106*e* represents 25 minutes, 106*f* represents 30 minutes, 106*g* represents 35 minutes, 106*h* represents 40 minutes, 106*i* represents 45 minutes, 106*j* represents 50 minutes, and 106*k* represents 55 minutes. If none of the five minute sections are activated, then 0 five minutes or the time between 0-4 minutes is represented.

Each five minute section 106 contains visually perceptible five minute indicator 116 that is activated at the appropriate time. For example, at 1 o'clock and 10 minutes, the visually perceptible hour indicator 114 contained in hour section 104*b* is activated and the visually perceptible five minute indicator 116 contained in 106*b* is activated. By way of example and not of limitation, visually perceptible five minute indicator 116 may be a LED light 116*a*, light bulb, neon, or some other illumination source capable of producing a visual indicator. In one embodiment, five minute sections 106 may be transparent or translucent such that upon activation of a visually perceptible five minute indicator 116, at least a portion of the appropriate five minute section 106 glows or is illuminated 116*b* or the entire appropriate five minute section 106 glows or is illuminated 116*c*. The color or visual appearance of visually perceptible five minute indicator 116 may be the same, or different for each five minute section 106 or may change over the five minute interval such that during the five minute interval that a specific five minute section 106 is illuminated, the visual appearance changes. The visually perceptible five minute indicator 116 may complement visually perceptible hour indicator 114 to create an aesthetically pleasing appearance. As the time passes, each five minute section 106 that was previously illuminated may remain illuminated, blink, or may not be illuminated at all.

Figure 3:
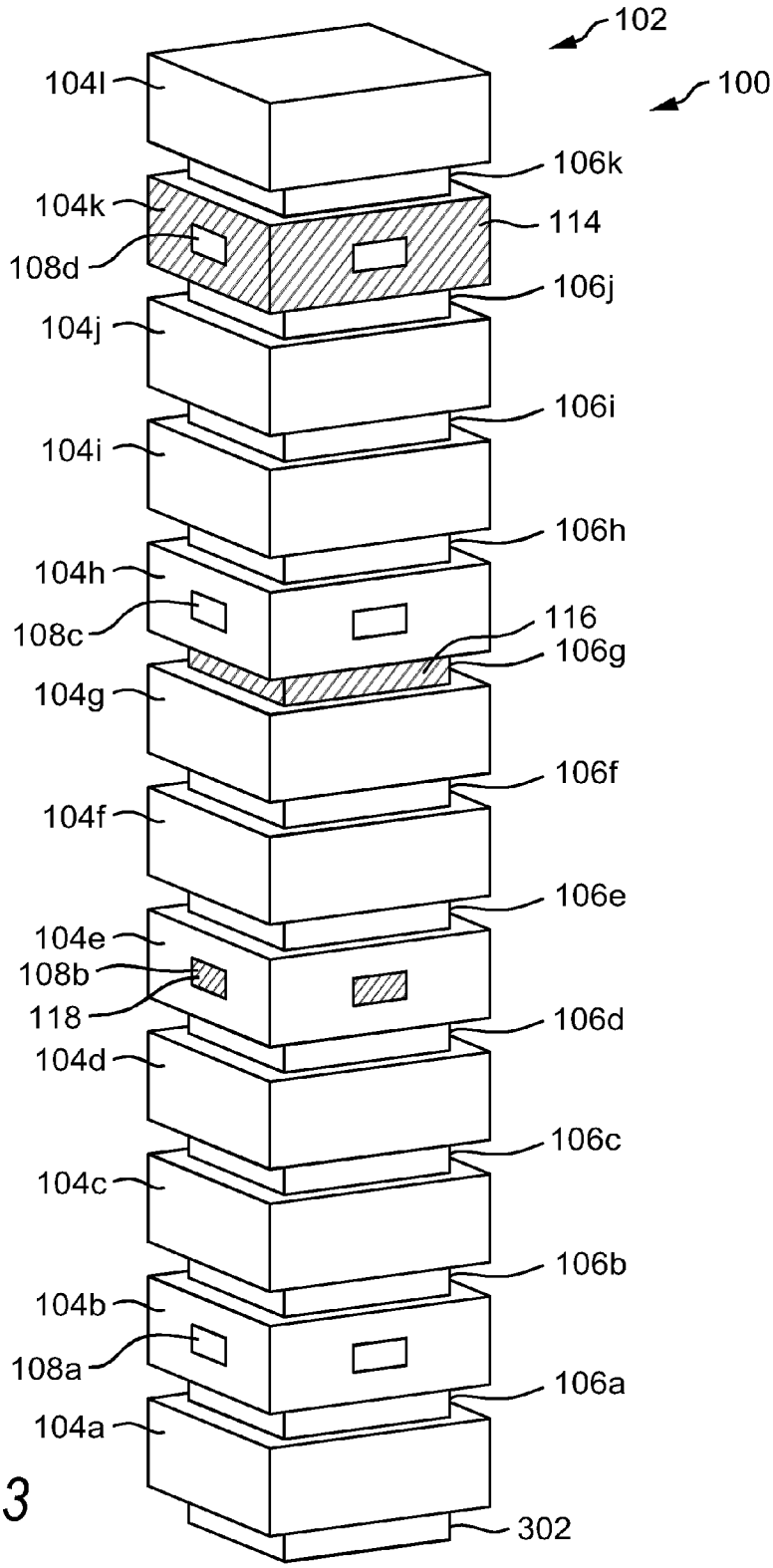
FIG. 3 is a profile view of a linear clock in accordance with an embodiment of the present invention.

One minute sections 108 are located on body 102. There are four one minute sections 108 and each section represents one minute increments from 1-4. For example, as shown in FIG. 1, 108*a* represents 1 minute, 108*b* represents 2 minutes, 108*c* represents 3 minutes, and 108*d* represents 4 minutes. If none of the one minute sections 108 are activated, then the minutes represented by five minute section 106 plus 0 minutes is represented. Each one minute section 108 contains visually perceptible one minute indicator 118 that is activated at the appropriate time. For example, as shown in FIG. 3, if visually perceptible hour indicator 114 in section 104*k* is activated, visually perceptible five minute indicator 116 in section 106*g* is activated, and one minute indicator 118 in section 108*b* is activated, then the time is 10:37. However if visually perceptible hour indicator 114 in section 104*k* is activated, visually perceptible five minute indicator 116 in section 106*g* is activated but none of the one minute indicators 118 in one minute section 108 are activated, then the time is 10:35.

By way of example and not of limitation, visually perceptible one minute indicator 118 may be a LED light 118*a*, light bulb, neon, or some other illumination source capable of producing a visual indicator. In one embodiment, one minute sections 108 may be transparent or translucent such that upon activation of visually perceptible one minute indicator 118, at least a portion of the appropriate one minute section 108 glows or is illuminated 118*b* or the entire appropriate one minute section 108 glows or is illuminated 118*c*. The color or visual appearance of visually perceptible one minute indicator 118 may be the same, or different for each one minute section 108 or may change over the four minute interval such that during the four minute interval that a specific one minute section 108 is illuminated the visual appearance changes. The visually perceptible one minute indicator 118 may complement visually perceptible hour indicator 114 and five minute indicator 116 to create an aesthetically pleasing appearance. As the time passes, each one minute section 108 that was previously illuminated may remain illuminated, blink, or may not be illuminated at all.

In one embodiment, 1 minute section 108*a* is located on or in hour section 104*b* that represents the 1 o'clock hour, 2 minute section 108*b* is located on or in hour section 104*e* that represents the 4 o'clock hour, 3 minute section 108*c* is located on or in hour section 104*h* that represents the 7 o'clock hour, and 4 minute section 108*d* is located on or in hour section 104*k* that represents the 10 o'clock hour. In another embodiment, 1 minute section 108*a* is located on or in hour section 104*c* that represents the 2 o'clock hour, 2 minute section 108*b* is located on or in hour section 104*e* that represents the 4 o'clock hour, 3 minute section 108*c* is located on or in hour section 104*h* that represents the 7 o'clock hour, and 4 minute section 108*d* is located on or in hour section 104*j* that represents the 9 o'clock hour. In yet another embodiment, 1 minute section 108*a* is located on or in hour section 104*a* that represents the 0/12 o'clock hour, 2 minute section 108*b* is located on or in hour section 104*d* that represents the 3 o'clock hour, 3 minute section 108*c* is located on or in hour section 104*g* that represents the 6 o'clock hour, and 4 minute section 108*d* is located on or in hour section 104*i* that represents the 9 o'clock hour. In yet another embodiment, 1 minute section 108*a* is located on or in the 5 minute section 106*b* that represents 10 minutes, 2 minute section 108*b* is located on or in the 5 minute section 106*e* that represents 25 minutes, 3 minute section 108*c* is located on or in the 5 minute section 106*g* that represents 35 minutes, and 1 minute section 108*d* is located within the 5 minute section 106*j* that represents 50 minutes. In another embodiment, the four minute sections are located within a single hour or 5 minute section.

Figure 2:
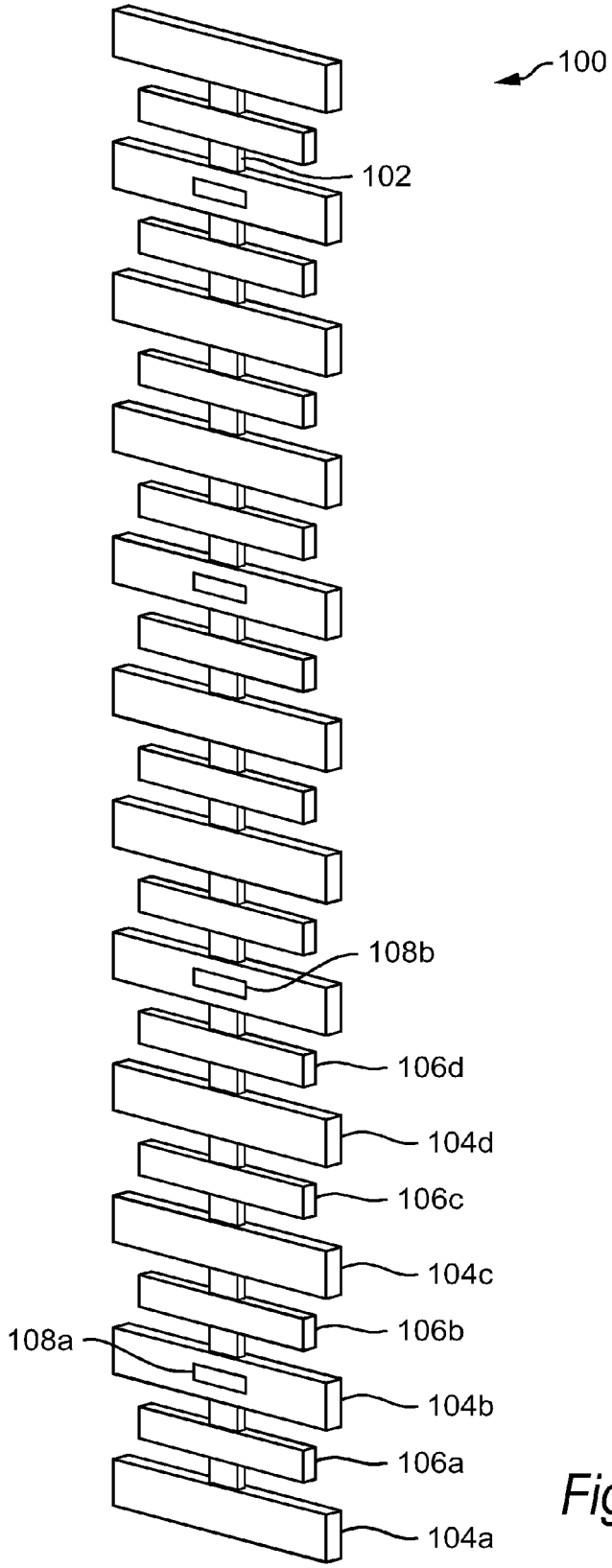
FIG. 2 is a profile view of a linear clock in accordance with an embodiment of the present invention.

In one embodiment, shown in FIG. 2, main body 102 has a relatively slim profile such that linear clock 100 may be hung from a wall or ceiling. For conciseness and clarity only a portion of hour sections 104, five minute sections 106, and one minute section 108 are labeled. In another embodiment, shown in FIG. 3, linear clock 100 contains base 302 that allows linear clock to be free standing. Base 302 supports main body 102 and may be weighted or secured to the floor such that base 302 and main body 102 create a relatively stable structure. In one embodiment, base 302 contains at least a portion of the electronics necessary to allow linear clock 100 to function. Base 302 may have an aesthetically pleasing exterior that matches or compliments the aesthetically pleasing exterior of main body 102. In one embodiment, base 302 contains at least one hour section 104.

Figure 4:
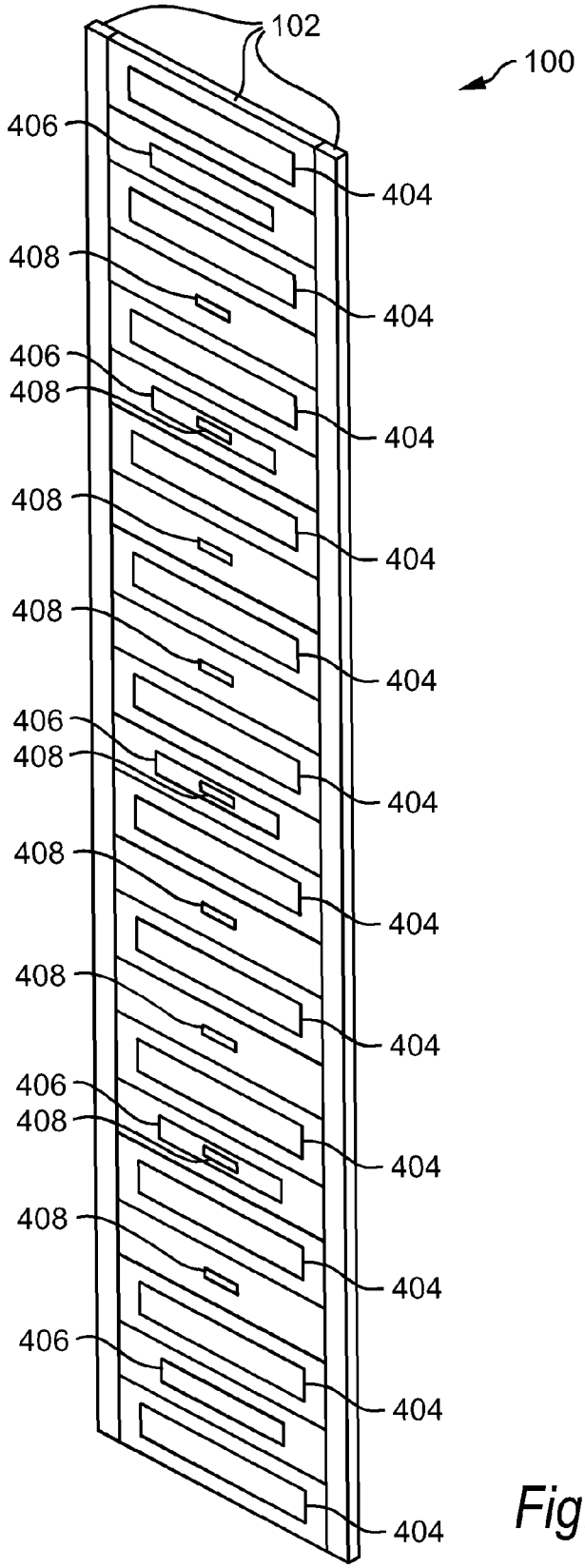
FIG. 4 is a profile view of a linear clock in accordance with an embodiment of the present invention.

In one embodiment, shown in FIG. 4, main body 102 contains 12 hour sections 404, five/10 minute sections 406, and nine one minute sections 408. While FIG. 4 shows a specific configuration or layout of 12 hour sections 404, five/10 minute sections 406, and nine one minute sections 408, each five/10 minute sections 406 and nine one minute sections 408 may be located at other places on body 102.

Figure 5:
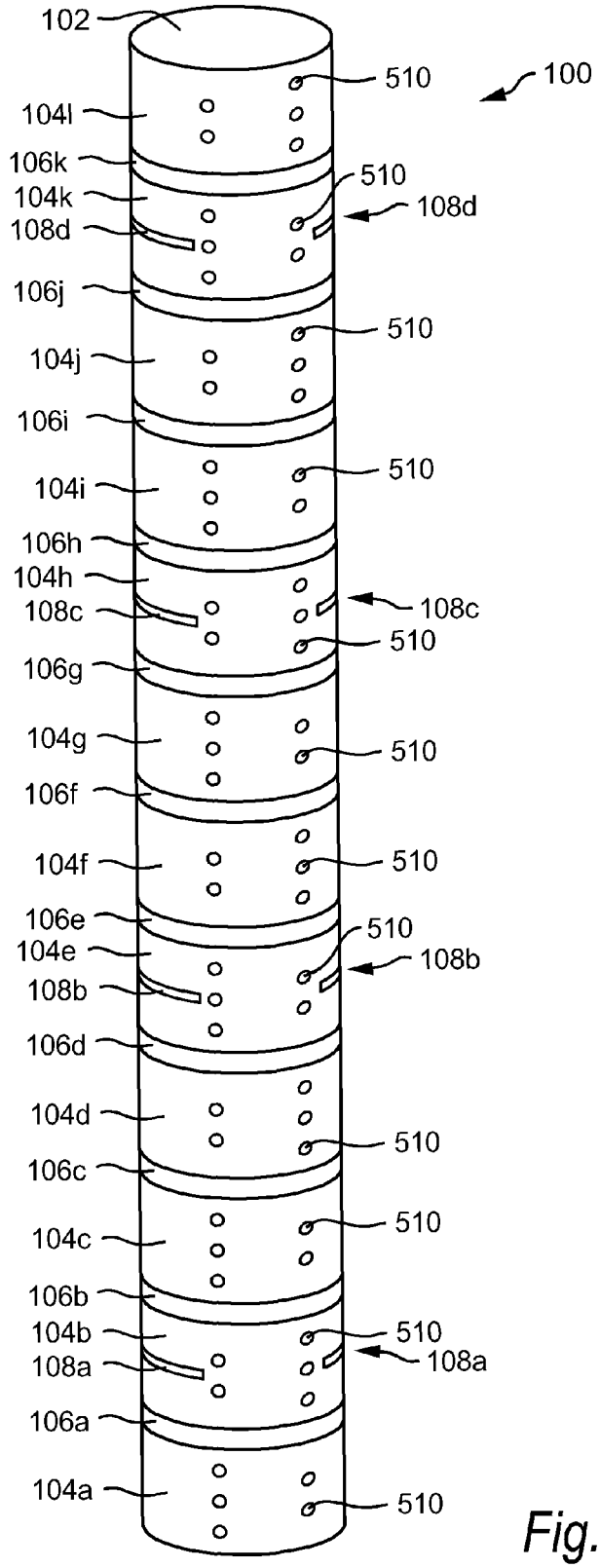
FIG. 5 is a profile view of a linear clock having second indicators in accordance with an embodiment of the present invention.

In one embodiment, second indicator 510 is located on body 102. For example, as shown in FIG. 5, five one second indicators 510 are located within each hour section 104. In another embodiment, a single second indicator 510 is located within hour sections 104*c*, 104*d*, 104*f*, 104*g*, 104*i*, and 104*j*. The second indicator 510 within 104*c* will blink up to 10 times, to signify 0-9 seconds. The second indicator 510 within 104*d* will blink up to 10 times, to indicate 10-19 seconds. The second indicator 510 within 104*f* will blink up to 10 times, to indicate 20-29 seconds. The second indicator 510 within 104*g* will blink up to 10 times, to indicate 30-39 seconds. The second indicator 510 within 104*i* will blink up to 10 times, to indicate 40-49 seconds. The second indicator 510 within 104*j* will blink up to 10 times, to indicate 50-59. In yet another embodiment, a second indicator 510 is located within hour sections 104*a*, 104*c*, 104*d*, 104*f*, 104*g*, 104*i*, 104*j* and 104*l*, as well as within each one minute indicator 108, or within the hour indicators 104*b*, 104*e*, 104*h* and 104*k*. In this embodiment, the second indicator 510 within 104*a* will blink up to 5 times, to signify 0-4 seconds. The second indicator 510 within either 104*b*, or 108*a* will blink up to 5 times, to signify 5-9. The second indicator 510 within 104*c* will blink up to 5 times, to indicate 10-14 seconds. The second indicator 510 within 104*d* will blink up to 5 times, to indicate 15-19 seconds. The second indicator 510 within either 104*e*, or 108*b* will blink up to 5 times, to signify 20-24. The second indicator 510 within 104*f* will blink up to 5 times, to indicate 25-29 seconds. The second indicator 510 within 104*g* will blink up to 5 times, to indicate 30-34 seconds. The second indicator 510 within either 104*h*, or 108*c* will blink up to 5 times, to signify 35-39. The second indicator 510 within 104*i* will blink up to 5 times, to indicate 40-44 seconds. The second indicator 510 within 104*j* will blink up to 5 times, to indicate 45-49 seconds. The second indicator 510 within either 104*k*, or 108*d* will blink up to 5 times, to signify 50-54. The second indicator 510 within 104*l* will blink up to 5 times, to signify 55-59.

In yet another embodiment, second indicator 510 is located within each of the four one minute indicators 108 wherein the second indicator 510 located within 108*a* will blink up to 15 times, to indicate 0-14 seconds, the second indicator 510 located within 108*b* will blink up to 15 times, to indicate 15-29 seconds, the second indicator 510 located within 108*c* will blink up to 15 times, to indicate 30-44 seconds, and the second indicator 510 located within 108*d* will blink up to 15 times, to indicate 45-59 seconds.

In addition, linear clock 100 may be calibrated or set with the radio signals from the atomic clock, electronic, mechanical or electromechanical means such as hour and minute set buttons or switches, or by electronics located within or on the body 102.

Figure 6:
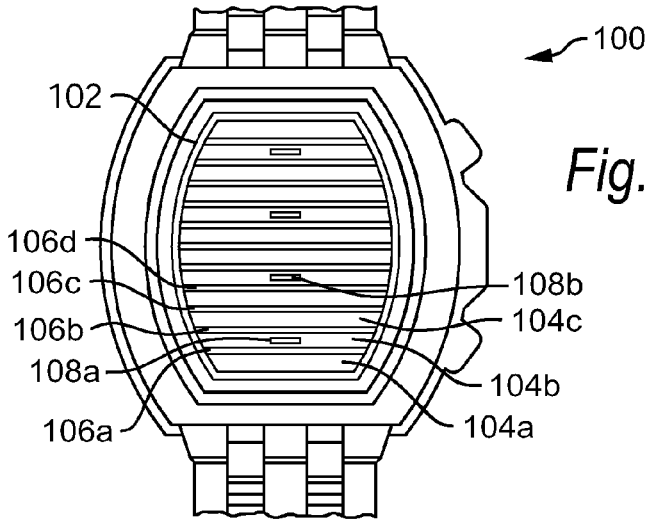
FIG. 6 is a plan view of a linear clock in accordance with an embodiment of the present invention.
Figure 7:
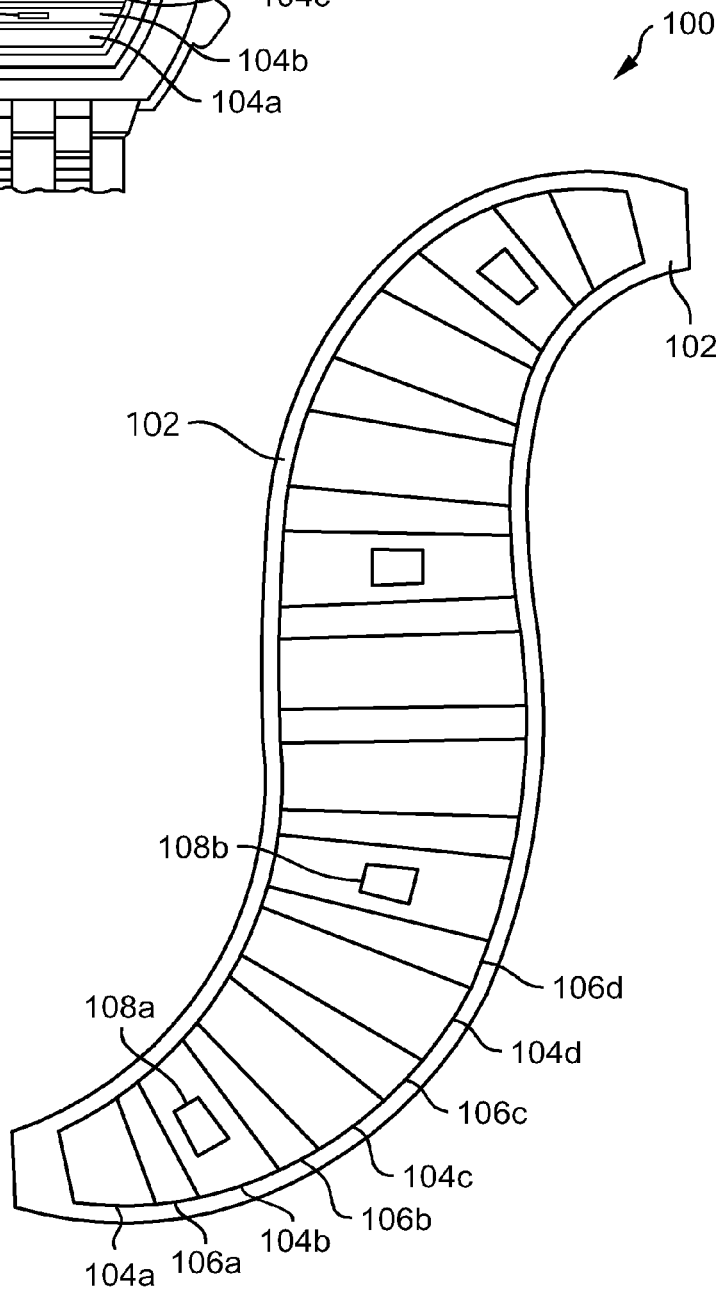
FIG. 7 is a plan view of a linear clock in accordance with an embodiment of the present invention.
Figure 8:
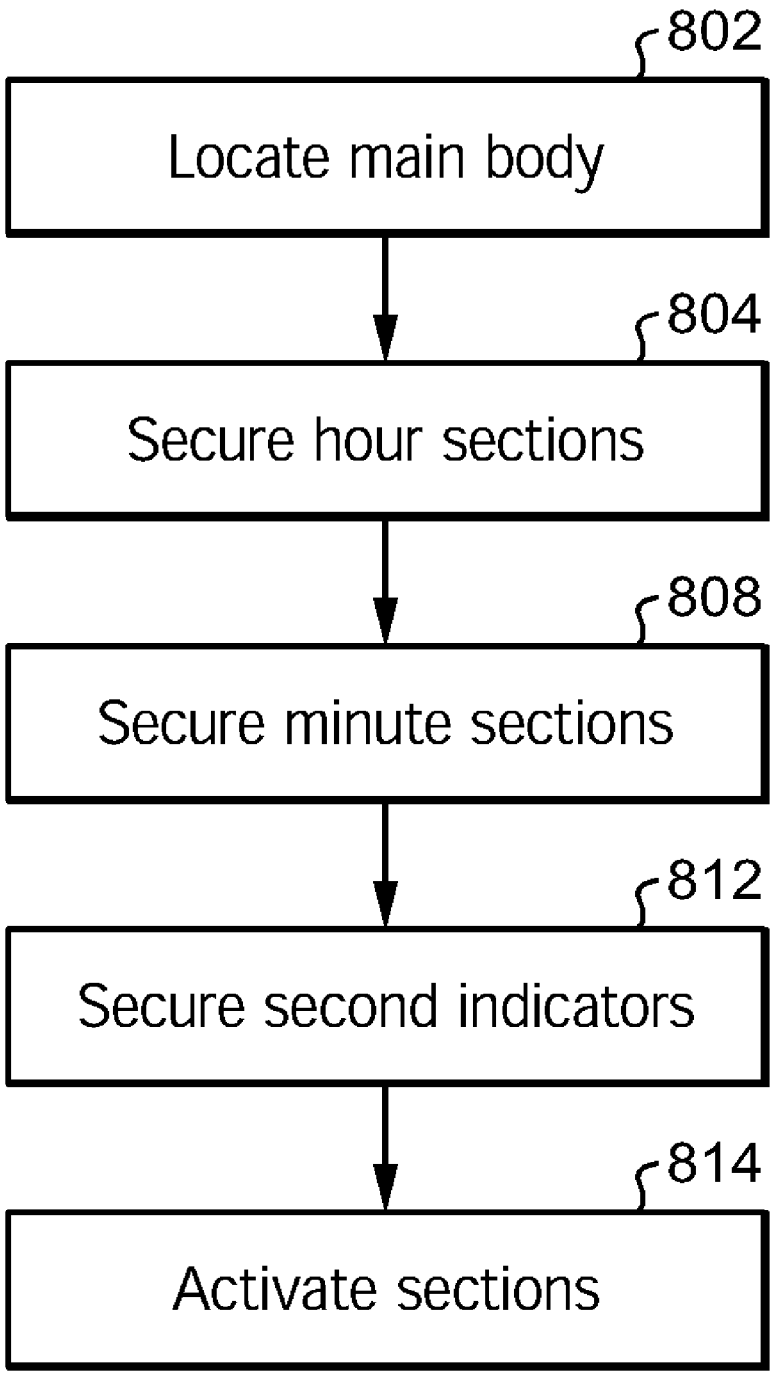
FIG. 8 is a block diagram showing the steps of making a linear clock in accordance with an embodiment of the present invention.

In another embodiment, shown in FIG. 6, linear clock 100 is a wrist watch and may be worn on a person's wrist. For conciseness and clarity only a portion of hour sections 104, five minute sections 106, and one minute section 108 are labeled. In yet another embodiment, shown in FIG. 7, body 102 is relatively flexible such that linear clock 100 can be twisted or flexed to create aesthetically pleasing shapes. For conciseness and clarity only a portion of hour sections 104, five minute sections 106, and one minute section 108 are labeled. FIG. 8 shows the steps in creating linear clock 100.

As shown in FIG. 8, first, a main body 102 is located, Step 802. Then, twelve hour sections 104 are attached to or positioned within main body 102, Step 804. Next, eleven five minute sections 106 are interposed between each hour section 104 and four one minute sections 108 are secured to body 102, Step 808. In one embodiment, one four one minute section 108 is located on or within hour section 104*b* that represents the 1 o'clock hour, one four one minute section 108 is located on or within hour section 104*e* that represents the 4 o'clock hour, one four one minute section 108 is located on or within hour section 104*h* that represents the 7 o'clock hour, and the final four one minute section 108 is located on or within hour section 104*k* that represents the 10 o'clock hour such that the four minute sections 108 are evenly spaced on body 102 and create an aesthetically pleasing appearance. In one embodiment, second indicators 110 are secured to body 102, Step 812. Then, twelve hour section 104, five minute section 106, one minute section 108, and second indicators 110 are be activated such that each section contains a visually perceptible indicator wherein when a specific combination of visually perceptible indicators is activated, an accurate time reading can be made, Step 814.

It should be understood that the foregoing relates to exemplary embodiments of the invention and that modifications may be made without departing from the spirit and scope of the invention as set forth in the following claims.

What is claimed is:

1. A linear clock wherein the linear clock contains:

a main body;

twelve hour sections on the main body wherein each hour section contains an indicator that represents exclusively a unique hour in a twelve hour cycle;

eleven five minute sections interposed between the twelve hour sections wherein each five minute section contains an indicator that represents exclusively a unique five minute interval, the five minute sections in aggregate representing up to fifty-five minutes in five minute increments; and four one minute sections evenly spaced on the main body wherein each one minute section contains an indicator that represents exclusively a unique one minute interval, and the four one minute sections in aggregate representing a time from one to four minutes in one minute increments; and, the main body defining a single column in which at least the twelve hour sections and the eleven five minute sections are stacked and alternating.

2. The linear clock of claim 1 wherein the body has a first end and a second end and the first and second ends are wider than the middle.

3. The linear clock of claim 1 wherein the body has a first end and a second end and the first and second ends are narrower than the middle.

4. The linear clock of claim 1 wherein the linear clock contains a base and the linear clock is free standing.

5. The linear clock of claim 1 wherein the linear clock can be hung on a wall.

6. The linear clock of claim 1 wherein the body of the linear clock is flexible and can be bent or curved.

7. The linear clock of claim 1 wherein the body contains at least one second indicator that indicate the seconds.

8. The linear clock of claim 1 wherein the first minute section is located on the hour section that represents the 1 o'clock hour, the second minute section is located on the hour section that represents the 4 o'clock hour, the third one minute section is located on the hour section that represents the 7 o'clock hour, and the fourth one minute section is located on the hour section that represents the 10 o'clock hour such that the four minute sections are evenly spaced on the body.

9. The linear clock of claim 1 wherein the linear clock may be worn as a wrist watch.

10. A method for creating a linear clock, the method comprising the steps of locating a main body;

attaching twelve hour sections to the main body and allowing each hour section to be activated at an appropriate time interposing eleven five minute sections between each hour section and allowing each five minute section to be activated at an appropriate time; and attaching four one minute sections to the main body and allowing each one minute section to be activated at an appropriate time such that when the hour section, five minute section, and one minute section is activated, a linear clock is created that can accurately indicate the time; and, arranging at least the twelve hour sections and the eleven five minute sections in a stacked and alternating pattern in which the main body defines a single column.

11. The method of claim 10 wherein the body has a top end and a bottom end and the top and bottom end are tapered.

12. The method of claim 10 wherein the linear clock contains a base and the linear clock is free standing.

13. The method of claim 10 wherein the linear clock can be hung on a wall.

14. The method of claim 10 wherein the body of the linear clock is flexible and can be bent or curved.

15. The method of claim 10 wherein the body contains at least one second indicator that indicate the seconds.

16. The method of claim 10 wherein the linear clock is calibrated by the atomic clock.

17. The method of claim 10 wherein the first minute section is located on the hour section that represents the 1 o'clock hour, the second minute section is located on the hour section that represents the 4 o'clock hour, the third one minute section is located on the hour section that represents the 7 o'clock hour, and the fourth one minute section is located on the hour section that represents the 10 o'clock hour such that the four minute sections are evenly spaced on the body.

18. The method of claim 10 wherein the linear clock may be worn as a wrist watch.

19. A linear clock wherein the linear clock contains:

a main body;

twelve hour sections on the main body wherein each hour section contains an indicator that exclusively represents a unique one hour interval in a twelve hour cycle;

five ten minute sections interposed between the twelve hour sections wherein each ten minute section contains an indicator that represents exclusively a unique ten minute interval, and the five tell minute sections in aggregate representing up to fifty minutes in ten minute increments;

nine one minute sections wherein each one minute section contains an indicator that exclusively represents a unique one minute interval, and the nine one minute sections in aggregate representing up to nine minutes in one minute increments, and the main body defines a single column in which the twelve hours sections, the five ten minute sections and the nine one minute sections are stacked, and alternating.

20. The linear clock according to claim 19 in which the twelve hour sections differ in shape from the five ten minute sections, and the time minute sections differ in shape from both the twelve hour sections and the five ten minute sections.

21. The linear clock according to claim 19 in which the indicators face different directions.

* * * * *